US008702088B2

(12) United States Patent
Kashiwabuchi

(10) Patent No.: US 8,702,088 B2
(45) Date of Patent: Apr. 22, 2014

(54) AUTOMATIC TRANSACTION APPARATUS

(75) Inventor: Masashi Kashiwabuchi, Gunma (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 13/517,983

(22) PCT Filed: Nov. 19, 2010

(86) PCT No.: PCT/JP2010/070738
§ 371 (c)(1),
(2), (4) Date: Jun. 20, 2012

(87) PCT Pub. No.: WO2011/077876
PCT Pub. Date: Jun. 30, 2011

(65) Prior Publication Data

US 2012/0255832 A1 Oct. 11, 2012

(30) Foreign Application Priority Data

Dec. 25, 2009 (JP) ..... 2009-294806

(51) Int. Cl.
*B65H 5/06* (2006.01)

(52) U.S. Cl.
USPC ..... 271/4.04; 271/10.04; 271/10.13

(58) Field of Classification Search
USPC ..... 271/4.04, 10.04, 10.13, 272; 198/347.3, 198/459.8, 460.1, 575
See application file for complete search history.

(56) References Cited

U.S. PATENT DOCUMENTS 4,373,711 A * 2/1983 Foster et al. ..... 271/171
4,607,831 A * 8/1986 Raybuck ..... 271/240
4,878,087 A * 10/1989 Sakai et al. ..... 399/20
5,755,435 A * 5/1998 Fujiwara ..... 271/4.04
5,806,650 A * 9/1998 Mennie et al. ..... 194/206
6,062,557 A * 5/2000 Kusumi ..... 271/10.13
6,796,558 B1 * 9/2004 Dorer ..... 271/189
6,955,253 B1 * 10/2005 Mazur et al. ..... 194/207
7,621,519 B2 * 11/2009 Sagawa et al. ..... 271/4.01
7,722,028 B2 * 5/2010 Bitner ..... 271/35
7,789,386 B2 * 9/2010 Mizutani ..... 271/272
7,992,858 B2 * 8/2011 Sagawa et al. ..... 271/10.01
8,240,225 B2 * 8/2012 Chu et al. ..... 74/352
8,366,097 B2 * 2/2013 Tu et al. ..... 271/10.13

FOREIGN PATENT DOCUMENTS

CN 101445192 A 6/2009
JP 6-9099 A 1/1994
JP 2000-62976 A 2/2000
JP 3207504 B2 9/2001
JP 2005-346505 A 12/2005

* cited by examiner

*Primary Examiner* — Douglas Hess
(74) *Attorney, Agent, or Firm* — Rabin & Berdo, P.C.

(57) ABSTRACT

Disclosed is an automatic transaction apparatus 1 provided with a temporary accumulating unit that accumulates paper money temporarily and discharges them again, wherein jammed paper money can be discharged and removed easily with a simple construction. The automatic transaction apparatus 1, which is provided with the temporary accumulating unit 30 that accumulates paper money 7*a* temporarily by conveying the paper money 7*a* with a conveyor roller section 40 and winding them around a drum 60, and dispenses the temporarily accumulated paper money 7*a* from the drum 60 and discharges them from the conveyor roller section 40, was also provided with a manipulation knob 100 that is pushed-in between a gear 65 that rotates the drum 60 and a gear 47 that rotates the conveyor roller section 40, and intermeshed to the gears, enabling the knob to rotate both the gears simultaneously.

5 Claims, 7 Drawing Sheets

CLOSED STATE

OPEN STATE

CLOSED STATE

OPEN STATE

AUTOMATIC TRANSACTION APPARATUS

TECHNICAL FIELD

The present invention relates to technology for removing medium that has been left behind in an automatic transaction apparatus, such as an automated teller machine, into which a medium such as cash is introduced and a desired transaction performed.

BACKGROUND ART

In an automatic transaction apparatus such as an automated teller machine, generally when the medium to be handled, for example a banknote, has been introduced, it is checked and counted in an authentication section, then temporarily accumulated in a temporary accumulating unit. When the amount for deposit has been confirmed, the banknotes are then conveyed so as to be accumulated in a banknote storage section. Configuration is made such that when the banknote encounter a conveying error, such as a jam, at this point in time, an operator can remove a banknote that has been left behind in the conveying path by manually rotating operation knobs.

Examples of methods for temporary accumulation include, for example, a method in which banknotes are wound around a circular cylindrical shaped drum using tape. A temporary accumulating unit employing such a method is configured, as shown in FIG. 7, including: a conveying roller section 40 for conveying a banknote 7*a* that has been introduced by a user along to a drum 60; and the drum 60 for accumulating a banknote 7*b* that has been conveyed from the conveying roller section 40, by winding the banknote 7*b* on the drum 60 using tape, not shown in the drawings.

The conveying roller section 40 is configured from a drive roller 41*a* and a coaxial drive roller 41*b*, and a following roller 42*a* and a coaxial following roller 42*b* that are each pressed by and follow rotation of their respective drive rollers.

Further, a gear 44 is provided to an end of a roller shaft 43 of the drive rollers 41*a*, 41*b*, and a gear 47 is provided on a motor shaft 46 of a conveying motor 45. The gear 44 and the gear 47 are meshed together so as to provide a configuration in which rotation of the conveying motor 45 is transmitted to the drive rollers 41.

On the other hand, on the drum 60 side there is also a gear 62 provided on a drum shaft 61 of the drum 60 for winding banknotes 7*b* on, and a gear 65 is provided on a motor shaft 64 of a drum drive motor 63. The gear 62 and the gear 65 are meshed together so as to provide a configuration in which rotation of the drum drive motor 63 is transmitted to the drum 60.

In addition, a drum knob 70, which is provided on the drum shaft 61 at the outside of the gear 62 for rotating the drum 60, and a roller knob 50, which is provided on the roller shaft 43 at the outside of the gear 44 for rotating the following rollers 42 together with the drive rollers 41, are provided to remove banknotes that have been left behind.

According to the above configuration, in the related temporary accumulating unit 30, the gear 47 is rotated in the arrow F direction by driving the conveying motor 45, the gear 44 meshed with the gear 47 rotates in the arrow E direction, rotating the drive rollers 41 in the arrow E direction, the following rollers 42 disposed against the drive rollers 41 accordingly undertake following rotation in the arrow D direction, and the banknote 7*a* nipped therebetween is conveyed towards the drum 60, namely in the arrow B direction.

Then the gear 65 is rotated in the arrow H direction by driving the drum drive motor 63, the gear 62 meshed with the gear 65 is rotated in the arrow G direction, rotating the drum 60 in the arrow C direction such that the banknote 7*b* is wound onto the drum 60 by tape, not shown in the drawings, and accumulated.

On the other hand, when a conveying error or the like occurs at the periphery of the drum 60, configuration is made such that the drum knob 70 is rotated in the opposite direction to the arrow G direction, conveying the banknote 7*b* in the opposite direction to the arrow C direction. The roller knob 50 is then rotated in the opposite direction to the arrow E direction, the banknote 7*b* is accordingly conveyed from the conveying roller section 40 in the opposite direction to the arrow B direction, and can then be ejected from the temporary accumulating unit 30.

When this is performed, the drum 60 and the conveying roller section 40 are separate drive systems and if the drum knob 70 is rotated alone then the conveying roller section 40 does not rotate. Hence, when a banknote 7 has become stuck at a location on the conveying roller section 40 the following issues arise. Thus, when using one hand, both the drum knob 70 and the roller knob 50 need to be alternately rotated, and it takes time to remove the banknote 7. Further, if both hands are employed to rotate the drum 60 and the conveying roller section 40 together at the same time, the banknote 7 that has been removed cannot be caught since both hands are full, and so gets dropped.

Technology for jam processing employing a single operation knob has been proposed in order to address the above issues (see for example Japanese Patent No. 3207504). According to a sheet conveying apparatus of Japanese Patent No. 3207504, in a conveying device an upstream side conveying roller is rotationally driven by a first drive motor and a downstream side conveying roller is rotationally driven by a second drive motor. During conveying, rotation from first and second rotation transmission systems is prevented from being transmitted to a third rotation transmission system by a one-way clutch. However during jam processing, rotation of an operation knob is transmitted to the first and the second rotation transmission systems through the third rotation transmission system. Each of the conveying rollers is accordingly rotated so as to feed out jammed paper.

DISCLOSURE OF INVENTION

Technical Problem

However, the method of the above Japanese Patent No. 3207504 requires provision of a high cost one-way clutch mechanism between the first and second rotation transmission systems. Furthermore, since a one-way clutch mechanism is provided, such technology cannot be employed in a mechanism such as a temporary accumulating unit in which banknotes that have been temporarily accumulated are then re-conveyed by rotating a drum and conveying roller in the opposite direction to the direction during accumulation.

In the method of the above Japanese Patent No. 3207504 it is possible to rotate the operation knob in both a state in which the temporary accumulating unit has been shut (referred to below as a "closed state") and in a state in which the temporary accumulating unit has been opened (referred to below as a "open state"). There is therefore an issue of an operator mistakenly operating the operation knob when the apparatus is running.

Solution to Problem

The present invention employs the following configuration in order to address the above issues. Namely, an automatic transaction apparatus is provided including a temporary accumulating unit for conveying a medium with a conveying section, accumulating the medium, and then re-conveying the medium, wherein: an operation knob is provided for inserting between and meshing with a gear for rotating the conveying section and a gear for rotating the temporary accumulating unit such that both the gears are capable of being rotated at the same time.

Advantageous Effects of Invention

According to the automatic transaction apparatus of the present invention, configuration is made with the automatic transaction apparatus provided so as to include the temporary accumulating unit for conveying a medium with the conveying section, accumulating the medium, and then re-conveying the medium. The operation knob is also provided for inserting between and meshing with the gear for rotating the conveying section and the gear for rotating the temporary accumulating unit such that both the gears are capable of being rotated at the same time. Accordingly, a jammed banknote can accordingly be easily removed using a simple configuration even in an automatic transaction apparatus having a temporary accumulating unit requiring two-way conveying.

DESCRIPTION OF EMBODIMENTS

Figure 1:
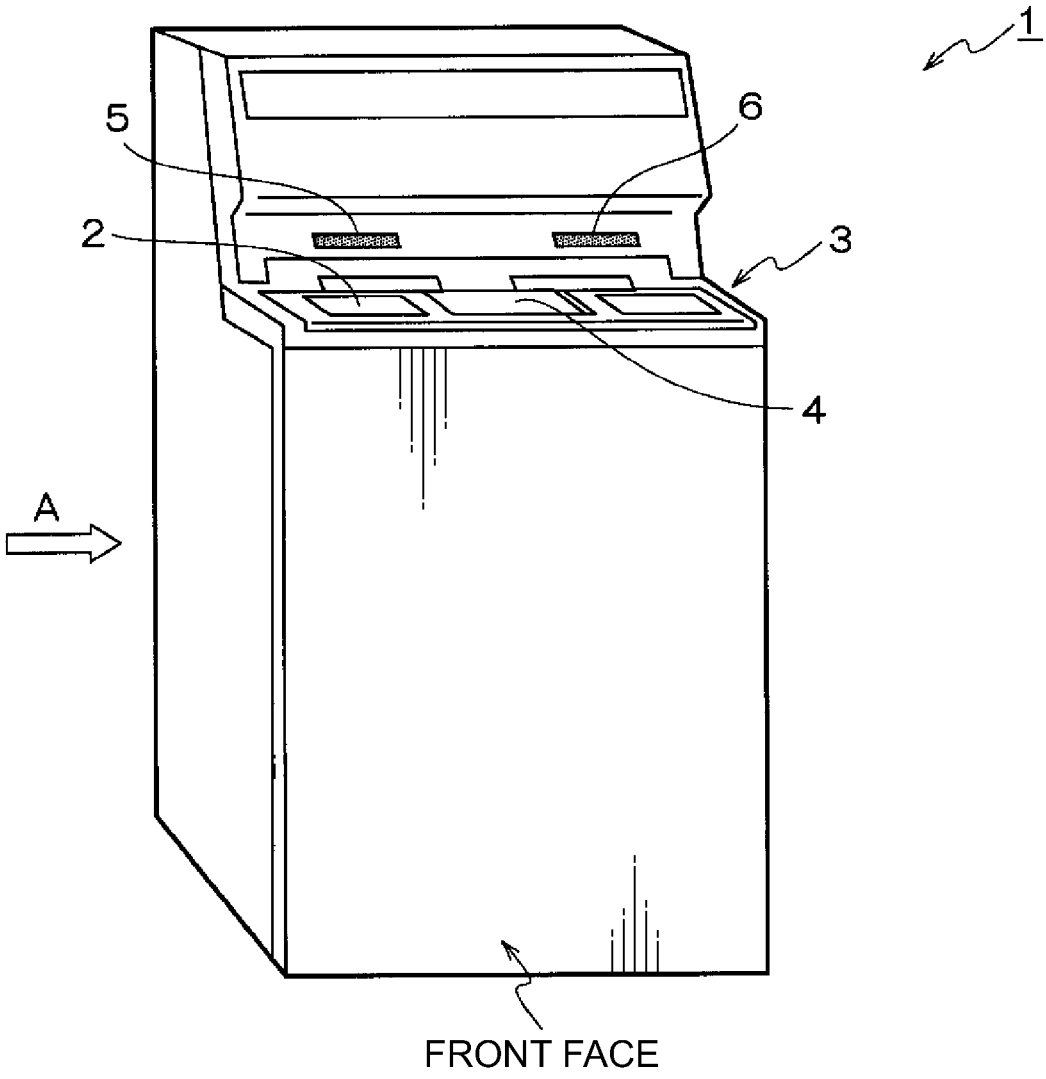
FIG. 1 is a schematic perspective view of an automatic transaction apparatus of a first exemplary embodiment.

Explanation follows regarding an exemplary embodiment according to the present invention, with reference to the drawings. Common elements in the drawings are allocated the same reference numerals. In the following exemplary embodiment explanation is given of cases in which a banknote is employed as an example of a medium, however a leaf shaped medium that is not a banknote may also be employed.

First Exemplary Embodiment

Configuration

An automatic transaction apparatus of a first exemplary embodiment has the external appearance as shown in FIG. 1, and includes a coin deposit and withdrawal port 2, a banknote deposit and withdrawal port 3, an operation section 4, a passbook insertion port 5 and a card insertion port 6.

The coin deposit and withdrawal port 2 and the banknote deposit and withdrawal port 3 are opening portions for the introduction and withdrawal of coins or banknotes, respectively. A shutter is provided to the coin deposit and withdrawal port 2 and to the banknote deposit and withdrawal port 3, respectively. The coin deposit and withdrawal port 2 and the banknote deposit and withdrawal port 3 are each opened or closed by movement of respective shutters. A coin handling section 25 or a banknote handling section 26 are provided at the far portions of these ports for performing coin or banknote deposit and withdrawal processing, described later.

The passbook insertion port 5 is a portion into which a passbook for use in a transaction is inserted, and from out of which the passbook is ejected when the transaction is complete. A passbook processing section 23 is provided at a back portion thereof. The card insertion port 6 is a portion into which a card is inserted or from which a card is ejected. A card processing section 21, described later, is provided at a back portion thereof.

The operation section 4 is configured with an LCD, for displaying an operation screen during a transaction, integrated to a touch panel for inputs such as transaction selection, PIN number and transaction amount.

Figure 2:
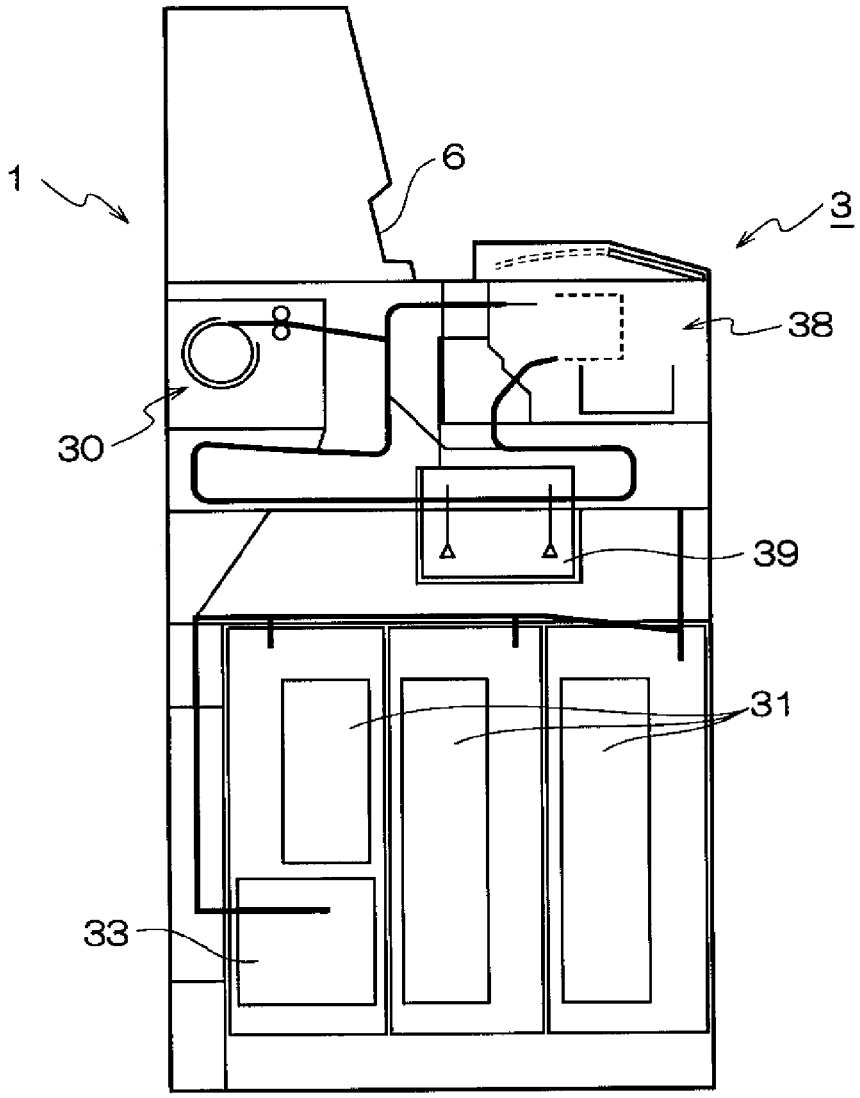
FIG. 2 is a side view of an automatic transaction apparatus of the first exemplary embodiment, as viewed from the arrow A direction of FIG. 1.

FIG. 2 is a side view illustrating the internal configuration of an automatic transaction apparatus of the first exemplary embodiment, as seen from the arrow A direction of FIG. 1. The coin handling section 25 has been omitted from illustration for simplicity. As shown in FIG. 2, inside the automatic transaction apparatus of the first exemplary embodiment are provided: a customer interface section 38 configured from the operation section 4 for user operation and the banknote deposit and withdrawal port 3; an authentication section 39 for determining the authenticity of banknotes; a temporary accumulating unit 30 where input banknotes are temporarily held; and denomination specific cassettes, provided at the bottom side of the apparatus and serving as a banknote storage section 31.

A reject banknote housing section 33 is also provided for housing banknotes rejected during transaction inspection and reject banknotes not taken by a user.

Figure 3:
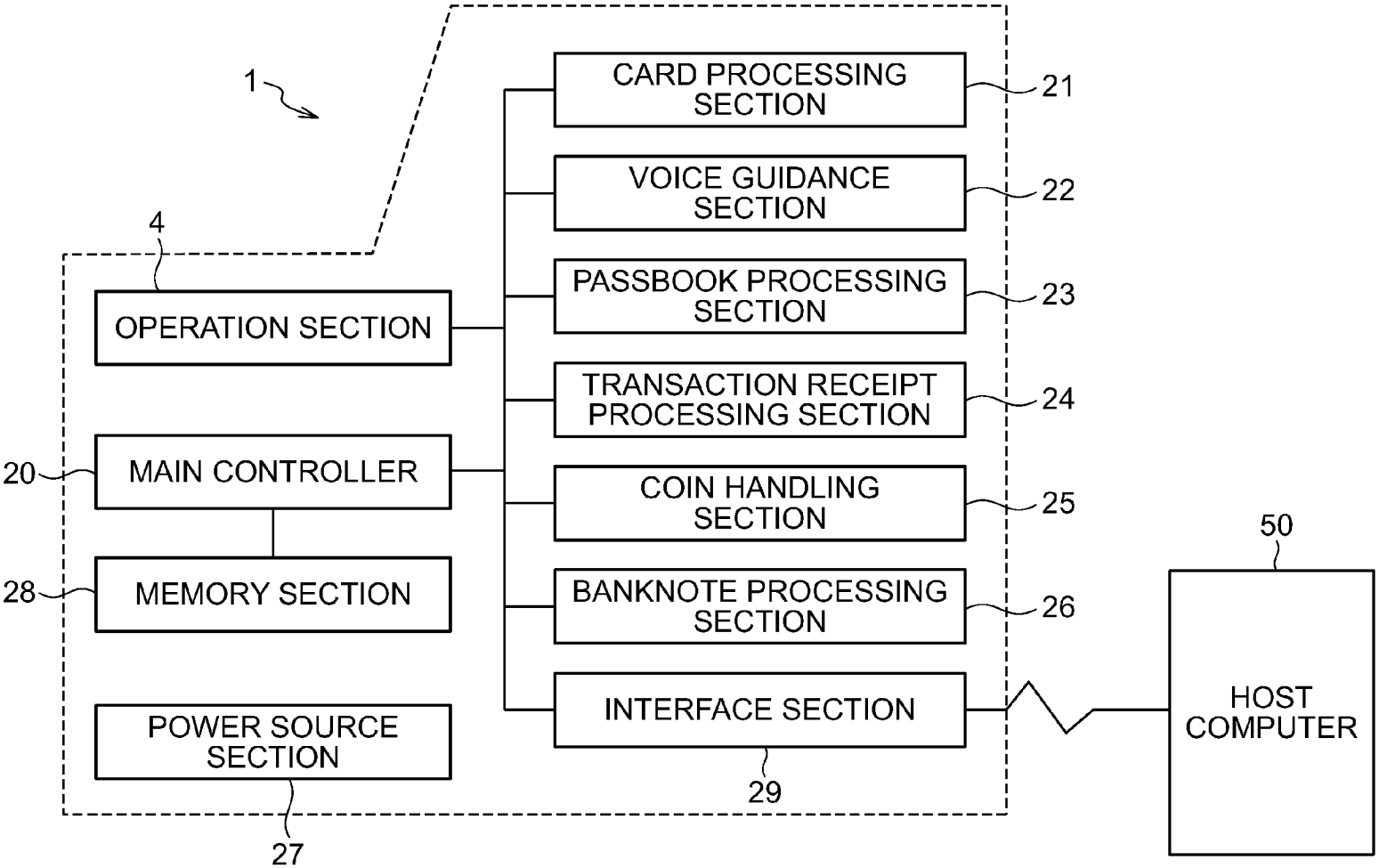
FIG. 3 is a control system block diagram of an automatic transaction apparatus of the first exemplary embodiment.

A control system of the automatic transaction apparatus of the first exemplary embodiment is, as shown in the control system block diagram of FIG. 3, provided with a main controller 20 for performing control on each section, described later, and the operation section 4 for operation by a user according to displayed guidance.

The control system of the automatic transaction apparatus of the first exemplary embodiment is also provided with: the card processing section 21 for performing read-write processing of data, such as the account number stored on a cash card; a voice guidance section 22 for voice output of guidance such as operation guidance; the passbook processing section 23 for performing read-write processing on a magnetic stripe of a passbook, in which data such as the account number is stored, and performing control of printing in the passbook; a transaction receipt processing section 24 for printing and outputting transaction receipts; a coin processing section 25 for controlling deposit and withdrawal of coins; and a banknote processing section 26 for controlling deposit and withdrawal of banknotes.

Further, there are provide a power source section 27 for supplying power to each section, a memory section 28 serving as a storage section, the memory section 28 acting as the storage section of the main controller 20 and able to store various control parameters, and an interface section 29 for controlling an interface with a host computer 50.

Figure 4:
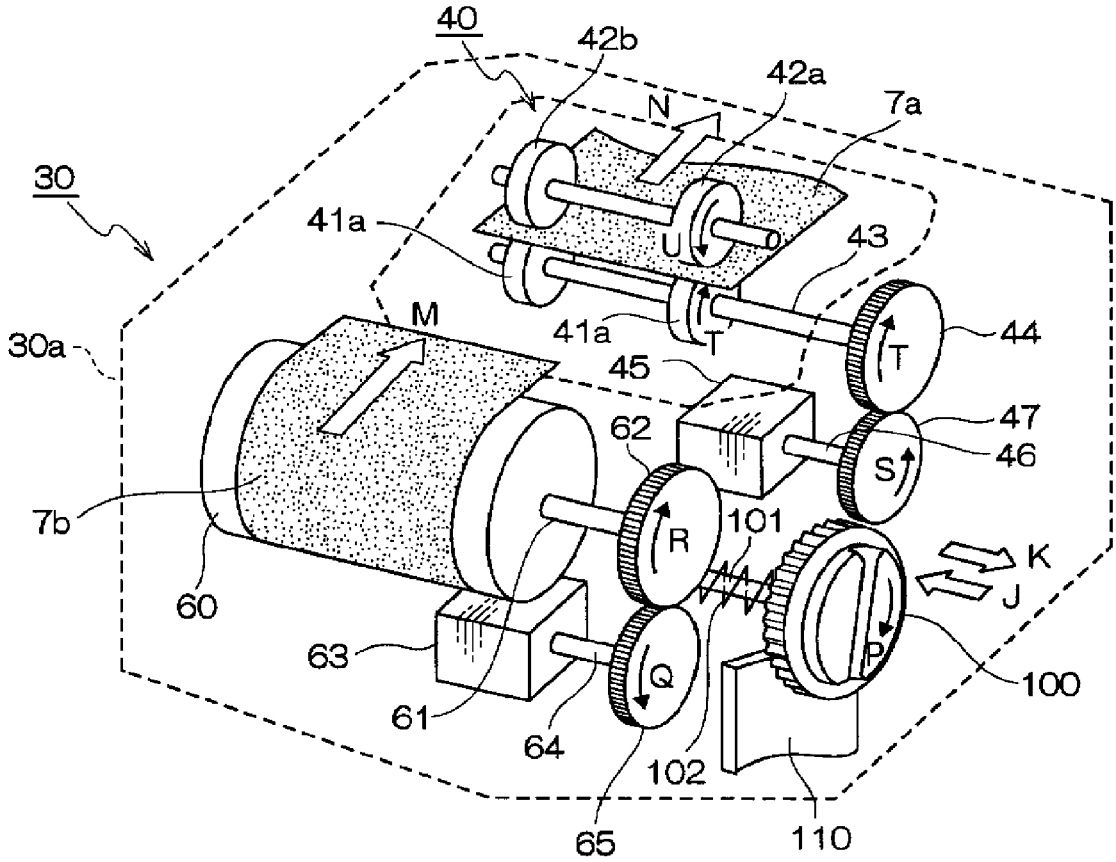
FIG. 4 is an explanatory diagram of the configuration and operation of a temporary accumulating unit of an automatic transaction apparatus of the first exemplary embodiment.

Next, explanation follows regarding a configuration of the temporary accumulating unit 30 of the automatic transaction apparatus of the first exemplary embodiment, with reference to FIG. 4. As shown in FIG. 4, the temporary accumulating unit 30 of the automatic transaction apparatus of the first exemplary embodiment is configured including: a conveying roller section 40 for conveying a banknote 7*a* that has been introduced by a user to a drum 60 serving an example of a temporary accumulating unit; and the drum 60 for accumulating a banknote 7*b* that has been conveyed from the conveying roller section 40, by winding the banknote 7*b* on the drum 60 using tape, not shown in the drawings.

Further, the conveying roller section 40 is configured from a drive roller 41*a* and a coaxial drive roller 41*b*, and a following roller 42*a* and a coaxial following roller 42*b* that are each pressed by and follow rotation of their respective drive rollers.

In addition, a gear 44 is provided to an end of a roller shaft 43 of the drive rollers 41*a*, 41*b*, and a gear 47 is provided on a motor shaft 46 of a conveying motor 45. The gear 44 and the gear 47 are meshed together so as to provide a configuration in which rotation of the conveying motor 45 is transmitted to the drive rollers 41.

On the drum 60 side there is also a gear 62 provided on a drum shaft 61 of the drum 60 for winding banknotes 7*b* on, and a rotation gear 65 is provided on a motor shaft 64 of a drum drive motor 63. The gear 62 and the gear 65 are meshed together so as to provide a configuration in which rotation of the drum drive motor 63 is transmitted to the drum 60.

An operation knob 100 is provided as an operation knob for removing banknotes that have been left behind. The operation knob 100 is formed with a profile so as to enable manual rotation and is provided with a gear profile for inserting between and meshing with a gear 65 and the gear 47.

The operation knob 100 is structured so as to be capable of sliding along the axial direction of a gear shaft 101 (the arrow J and the arrow K directions), and a coil spring 102 is provided to the gear shaft 101.

The operation knob 100 meshes with both the gear 65 and the gear 47 when the operation knob 100 is pushed in by a hand in the arrow J direction in the figure. On removing the hand, the operation knob 100 is pushed back in the arrow K direction by biasing force of the coil spring 102, thereby ceasing to mesh with the gear 65 and the gear 47.

A stay 110 is provided at the inside of the operation knob 100 of the temporary accumulating unit 30. When the temporary accumulating unit 30 is in an open state the stay 110 maintains the open state, as described later in detail with respect to FIG. 5. The stay 110 is rotatable about a support axis of a support shaft 110*a* attached at a fixed position, for example to the main body, of the automatic transaction apparatus 1. A slide hole 110*b* is provided to the stay 110, into which a projection portion 30*b* provided to a cover 30*a* of the temporary accumulating unit 30 fits and slides.

Due to provision of the stay 110 as described above, when the temporary accumulating unit 30 is in a closed state, the stay 110 is inserted at the inside of the operation knob 100, such that the stay 110 impedes the operation knob 100. Accordingly, the operation knob 100 does not move in the arrow J direction and meshing of the operation knob 100 with the gear 65 and the gear 47 does not occur even if the operation knob 100 is pushed in.

Operation

According to the above configuration, the temporary accumulating unit of the automatic transaction apparatus of the first exemplary embodiment operates as set out below. Detailed explanation follows regarding such operation, with reference to the operation explanatory diagrams of FIG. 4 and FIG. 5A, 5B. Since operation for performing temporary accumulation of the banknote 7 introduced by a user is similar to conventional operation, for simplicity explanation of further details thereof is omitted.

When a conveying problem or the like has occurred in the temporary accumulating unit 30, the cover 30*a* of the temporary accumulating unit 30 is opened, the operation knob 100 is pushed in along the arrow J direction, thereby coupling together the gear 65 and the gear 47. The operation knob 100 is then rotated in the arrow P direction.

The gear 65 meshed with the operation knob 100 then rotates in the arrow G direction, and the gear 62 meshed with the gear 65 rotates in the arrow R direction, such that a banknote 7*b* that has been left on the drum 60 is fed out in the arrow M direction.

The gear 47 meshed with the operation knob 100 also rotates in the arrow S direction, the gear 44 meshed therewith rotates in the arrow T direction and the drive rollers 41 also rotate in the arrow T direction. The following rollers 42 disposed against the drive rollers 41 accordingly undertake following rotation in the arrow U direction, and the banknote 7*a* nipped therebetween is ejected in the arrow N direction.

Figure 5A:
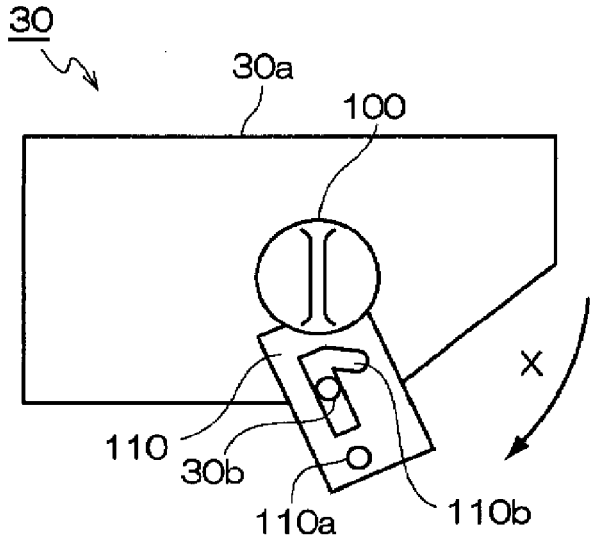
FIG. 5A is an explanatory diagram of the operation of a temporary accumulating unit of an automatic transaction apparatus of the first exemplary embodiment (closed state).

In a closed state when the temporary accumulating unit 30 has been shut along with the cover 30*a*, namely when the temporary accumulating unit 30 has been closed in the arrow X direction, as shown in FIG. 5A, the projection portion 30*b* provided to the cover 30*a* of the temporary accumulating unit slides along the slide hole 110*b* of the stay 110 to the position shown in FIG. 5A. The stay 110 rotates in the clockwise direction about a support axis of the support shaft 110*a*, positioning the stay 110 at the inside of the operation knob 100. Then even if the operation knob 100 is pushed towards the bottom face of the paper of FIG. 5A, namely in the arrow J direction of FIG. 4, the operation knob 100 is impeded by the stay 110 and cannot be pushed back so as to couple with the gear 65 and the gear 47, and the drum 60 and the conveying roller section 40 do not rotate even if the operation knob 100 is rotated.

Figure 5B:
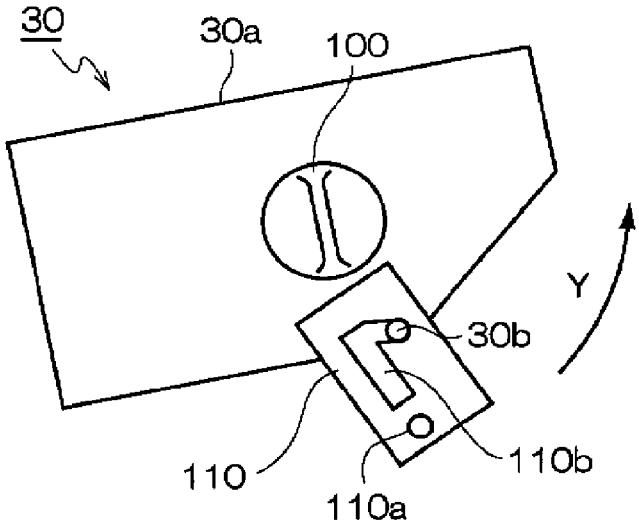
FIG. 5B is an explanatory diagram of the operation of a temporary accumulating unit of an automatic transaction apparatus of the first exemplary embodiment (open state).

On the other hand, when the temporary accumulating unit 30 is opened together with the cover 30*a* in the arrow Y direction to an open state, the closed state of FIG. 5A transitions to the open state of FIG. 5B, and the projection portion 30*b* provided to the temporary accumulating unit 30*a* slides along the slide hole 110*b* of the stay 110 to the position shown in FIG. 5B, and the stay 110 rotates in an anti-clockwise direction about a support axis of the support shaft 110*a*, so as to retreat from being disposed at the inside of the operation knob 100.

When the operation knob 100 is pushed in while in the open state, the operation knob 100 is not impeded by the stay 110, and the gear portion of the operation knob 100 couples with both the gear 65 and the gear 47. Then, as described above, when both the drum 60 and the conveying roller section 40 are rotated at the same time by the operation knob 100, the banknote 7*b* left behind in the drum 60 is unwound from the drum 60, and can then be ejected from the temporary accumulating unit 30 via the conveying roller section 40.

Explanation has been given of a case in the above exemplary embodiment in which a banknote jammed between the conveying roller section and the drum is removed. However, application may also be applied to a case for removing a banknote jammed in a drive system between one conveying roller on the conveying upstream side separated from another conveying roller on the conveying downstream side, by configuring such that the operation knob of the present invention can be inserted between and meshed with gears that drive these rollers so as to enable rotating.

Figure 6A:
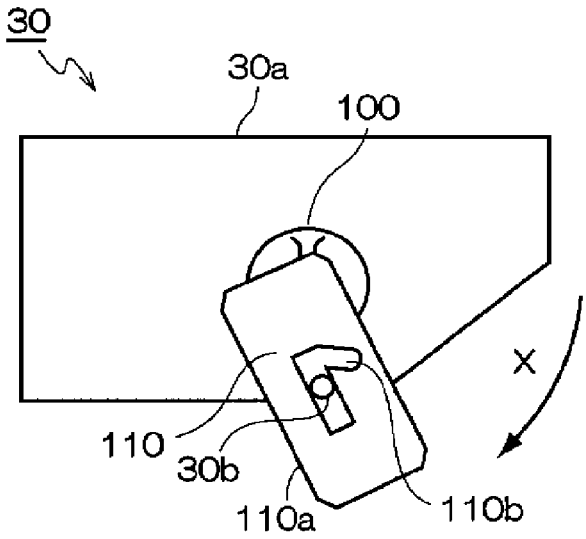
FIG. 6A is an explanatory diagram of the operation of a temporary accumulating unit of an automatic transaction apparatus in a modified example (closed state).
Figure 6B:
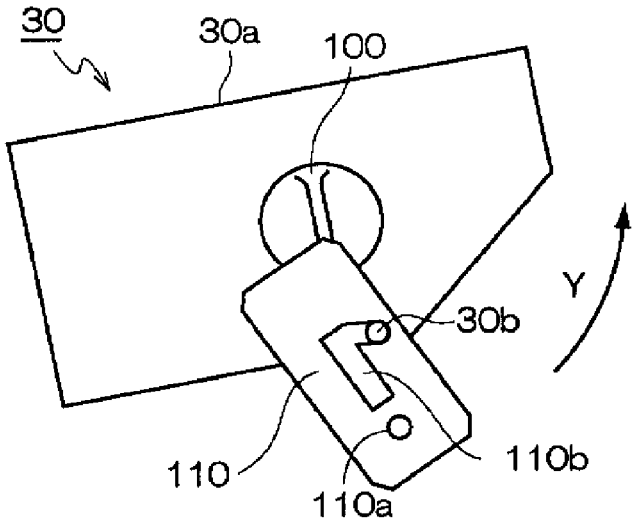
FIG. 6B is an explanatory diagram of the operation of a temporary accumulating unit of an automatic transaction apparatus in a modified example (open state).
Figure 7:
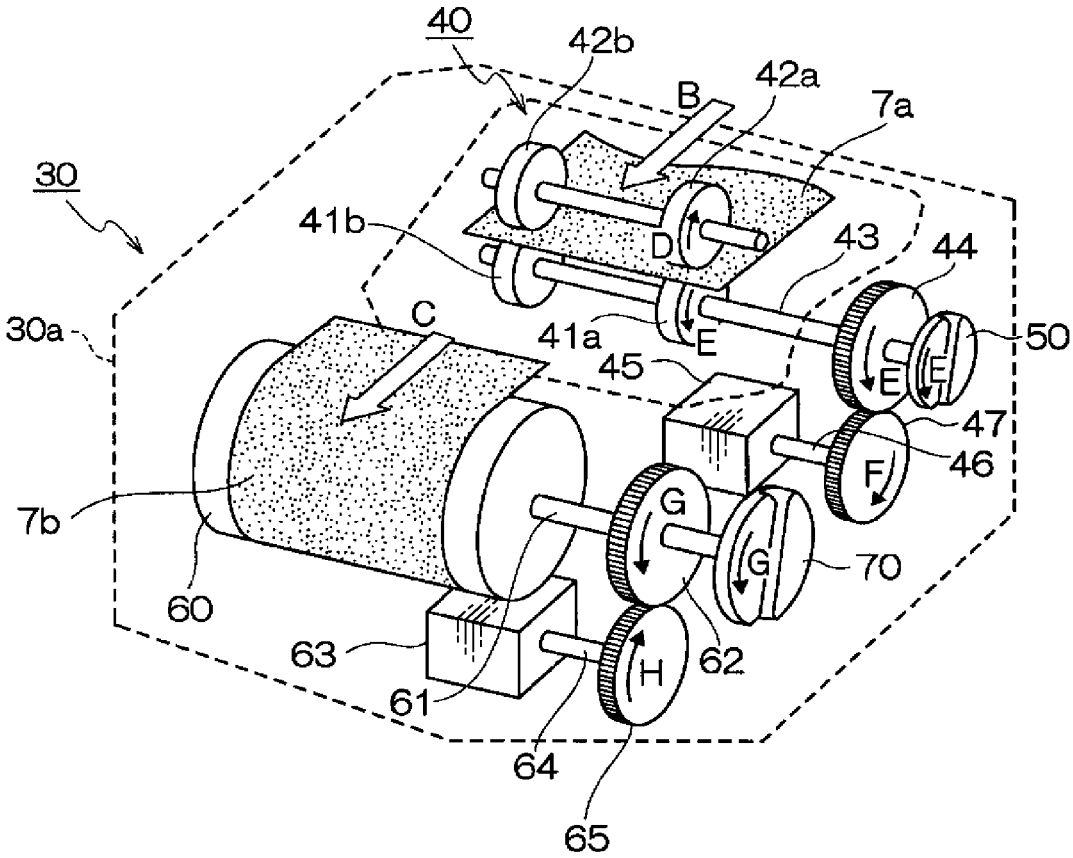
FIG.7 PRIOR ART
FIG. 7 is an explanatory diagram of the configuration and operation of a temporary accumulating unit of a related automatic transaction apparatus.

Furthermore, while explanation has been given in the above exemplary embodiment of a case in which the stay 110 is disposed at the inside of the operation knob 100 as shown in FIG. 5A and FIG. 5B, configuration may also be made such that the stay 110 is disposed at the outside of the operation knob 100, as shown in FIG. 6A and FIG. 6B. In such a case, in the closed state when the temporary accumulating unit 30 has been shut, as shown in FIG. 6A, the stay 110 covers the operation knob 100 so that it cannot be operated. In the open state when the temporary accumulating unit 30 has been opened, the stay 110 is separated from the operation knob 100, as shown in FIG. 6B, such that the operation knob 100 can be operated.

Advantageous Effects of First Exemplary Embodiment

The automatic transaction apparatus of the first exemplary embodiment, as described in detail above, is an automatic transaction apparatus equipped with a temporary accumulating unit that conveys banknotes with a conveying roller section, temporarily accumulates the banknotes by winding them around a drum, and unwinds the temporarily accumulated banknotes from the drum and ejects the banknotes from the conveying roller section. An operation knob is provided for inserting between and meshing with a gear for rotating the drum and a gear for rotating the conveying roller, enabling both the gears to be rotated at the same time. A jammed banknote can accordingly be easily removed using a simple configuration even in an automatic transaction apparatus having a temporary accumulating unit requiring two-way conveying.

Furthermore, a stay is provided that maintains an open state and retreats from a peripheral position to the operation knob when the temporary accumulating unit has been opened, and that moves to the operation knob peripheral position when the temporary accumulating unit is shut. Consequently, a configuration can be achieved such that the drum and the conveying roller are rotated by the operation knob only when the temporary accumulating unit is opened to eject a banknote that has been left behind.

INDUSTRIAL APPLICABILITY

As described above, the present invention can be widely applied to an automatic transaction apparatus such as an automated teller machine for temporarily accumulating and processing an introduced medium, such as cash.

The invention claimed is:

1. An automatic transaction apparatus comprising a temporary accumulating unit that conveys a medium via a conveying section, accumulates the medium, and then re-conveys the medium, wherein an operation knob is provided for insertion between and meshing with a gear that rotates the conveying section and a gear that rotates the temporary accumulating unit such that both the gears are capable of being rotated at the same time, the operation knob being movable to a position in which it is not inserted between the gears and does not mesh with the gears, and wherein a stay is provided such that the operation knob is capable of being inserted when the stay is moved to a first position in which it is spaced apart from the operation knob, and such that the stay prevents the operation knob from being inserted when the stay is moved to a second position in which a peripheral portion of the operation knob overlaps part of the stay.

2. The automatic transaction apparatus of claim 1, wherein the conveying section comprises a drive roller and a following roller facing the drive roller; and the temporary accumulating unit comprises a drum and accumulates by winding the medium around the drum.

3. The automatic transaction apparatus of claim 1, wherein the operation knob comprises a biasing portion that biases the operation knob in a direction towards the outside of the temporary accumulating unit, the direction being opposite to a direction in which the operation knob is inserted.

4. The automatic transaction apparatus of claim 1, wherein the stay is moved to the first position when the temporary accumulating unit is opened, and is moved to the second position when the temporary accumulating unit is closed.

5. The automatic transaction apparatus of claim 4, wherein:

the stay is rotatable about a pivot point of a support shaft that is disposed at a fixed position, and the stay has a slide hole into which a projection portion attached to a cover of the temporary accumulating unit fits and slides.

* * * * *